US010529481B2

(12) United States Patent
Tsukada et al.

(10) Patent No.: US 10,529,481 B2
(45) Date of Patent: Jan. 7, 2020

(54) THREE-PHASE REACTOR INCLUDING VIBRATION SUPPRESSING STRUCTURE PART

(71) Applicant: FANUC CORPORATION, Yamanashi (JP)

(72) Inventors: Kenichi Tsukada, Yamanashi (JP); Masatomo Shirouzu, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 68 days.

(21) Appl. No.: 15/865,831

(22) Filed: Jan. 9, 2018

(65) Prior Publication Data

US 2018/0204667 A1 Jul. 19, 2018

(30) Foreign Application Priority Data

Jan. 18, 2017 (JP) ..... 2017-006885

(51) Int. Cl.
*H01F 27/33* (2006.01)
*H01F 27/30* (2006.01)
*H01F 27/24* (2006.01)

(52) U.S. Cl.
CPC ..... *H01F 27/306* (2013.01); *H01F 27/24* (2013.01); *H01F 27/33* (2013.01)

(58) Field of Classification Search
CPC ..... H01F 27/00–36; H01F 27/306
USPC .... 336/65, 83, 170, 173, 210–215, 233–234
See application file for complete search history.

(56) References Cited

U.S. PATENT DOCUMENTS

| | | | | |
|---|---|---|---|---|
| 2,406,704 | A * | 8/1946 | Mossay | H01F 30/12 307/156 |
| 10,008,322 | B2 * | 6/2018 | Bhide | H01F 37/00 |
| 2006/0087393 | A1 | 4/2006 | Dahlgren et al. | |
| 2012/0146758 | A1 * | 6/2012 | Goto | H01F 27/06 336/212 |
| 2012/0326831 | A1 * | 12/2012 | Suzuki | H01F 27/263 336/233 |
| 2017/0154718 | A1 * | 6/2017 | Maeda | H01F 17/062 |

FOREIGN PATENT DOCUMENTS

| | | | |
|---|---|---|---|
| JP | H08148352 | A | 6/1996 |
| JP | 2007201129 | A | 8/2007 |
| JP | 2008-028288 | A | 2/2008 |
| JP | 2009-212384 | A | 9/2009 |
| JP | 2010252539 | A | 11/2010 |
| WO | 2010119324 | A2 | 10/2010 |
| WO | 2012032715 | A1 | 3/2012 |

* cited by examiner

*Primary Examiner* — Tuyen T Nguyen
(74) *Attorney, Agent, or Firm* — RatnerPrestia

(57) ABSTRACT

A three-phase reactor includes an outer peripheral iron core for surrounding the outer periphery of the three-phase reactor, and at least three iron core coils, which are in contact with or coupled to the inner surface of the outer peripheral iron core. The at least three iron core coils includes iron cores and coils wound around the iron cores. Gaps, which can be magnetically coupled, are each formed between two adjacent ones of the iron cores. The three-phase reactor further includes a vibration suppressing structure part disposed in the vicinity of the gaps so as to reduce vibrations occurring at the gaps.

1 Claim, 10 Drawing Sheets

THREE-PHASE REACTOR INCLUDING VIBRATION SUPPRESSING STRUCTURE PART

CROSS-REFERENCE TO RELATED APPLICATIONS

This application is a new U.S. Patent Application that claims benefit of Japanese Patent Application No. 2017-006885, filed Jan. 18, 2017, the disclosure of this application is being incorporated herein by reference in its entirety for all purposes.

BACKGROUND OF THE INVENTION

1. Field of the Invention

The present invention relates to a three-phase reactor.

2. Description of the Related Art

Vibrations may occur when a three-phase reactor, e.g., a three-phase AC reactor operates. The vibrations may generate noises, or deteriorate the three-phase reactor, and accordingly, it is necessary to reduce the vibrations. The cause of such vibrations is a magnetic force, which acts between two opposed iron cores with a gap being located therebetween or the magnetostriction of the iron cores of a reactor.

In Japanese Unexamined Patent Publication (Kokai) No. 2009-212384, iron cores of a reactor are secured to a plate. Further, Japanese Unexamined Patent Publication (Kokai) No. 2008-028288 discloses that a reactor is disposed within a housing, and leaf springs are disposed between the inner surface of the housing and the reactor.

SUMMARY OF THE INVENTION

However, the thicknesses of iron cores in the respective phases of a reactor differ depending on the conditions of manufacture and the tolerance of materials. Thus, when the thicknesses of the iron cores in the respective phases are different, securing iron cores using a plate as in Japanese Unexamined Patent Publication (Kokai) No. 2009-212384 is an insufficient measure because uneven forces are applied to the iron cores.

Further, the configuration disclosed in Japanese Unexamined Patent Publication (Kokai) No. 2008-028288 requires a housing and leaf springs. This increases the manufacturing cost, the dimensions of the entirety of a reactor, etc.

The present invention was made in view of these circumstances, and has an object to provide a three-phase reactor in which iron cores can be secured regardless of the difference between the thicknesses of the iron cores in the respective phases, and vibrations can be reduced without a drastic increase in the manufacturing cost and the dimensions.

In order to achieve the above object, according to a first aspect of the invention, there is provided a three-phase reactor including an outer peripheral iron core for surrounding the outer periphery of the three-phase reactor, and at least three iron core coils, which are in contact with or coupled to the inner surface of the outer peripheral iron core. The at least three iron core coils include iron cores and coils wound around the iron cores. Gaps, which can be magnetically coupled, are each formed between two adjacent ones of the iron cores. The three-phase reactor further includes a vibration suppressing structure part disposed in the vicinity of the gaps so as to reduce vibrations occurring at the gaps.

In the first aspect, the vibration suppressing structure part, which includes a vibration reducing part and a fixture, is disposed only in the vicinity of the gaps. Thus, the size of the three-phase reactor is not increased by the vibration suppressing structure part, and the manufacturing cost is not drastically increased. Further, the iron cores can be secured without depending on the thickness of the iron cores in phases.

These objects, features, and advantages of the present invention and other objects, features, and advantages will become further clearer from the detailed description of typical embodiments illustrated in the appended drawings.

DETAILED DESCRIPTION

Figure 1A:
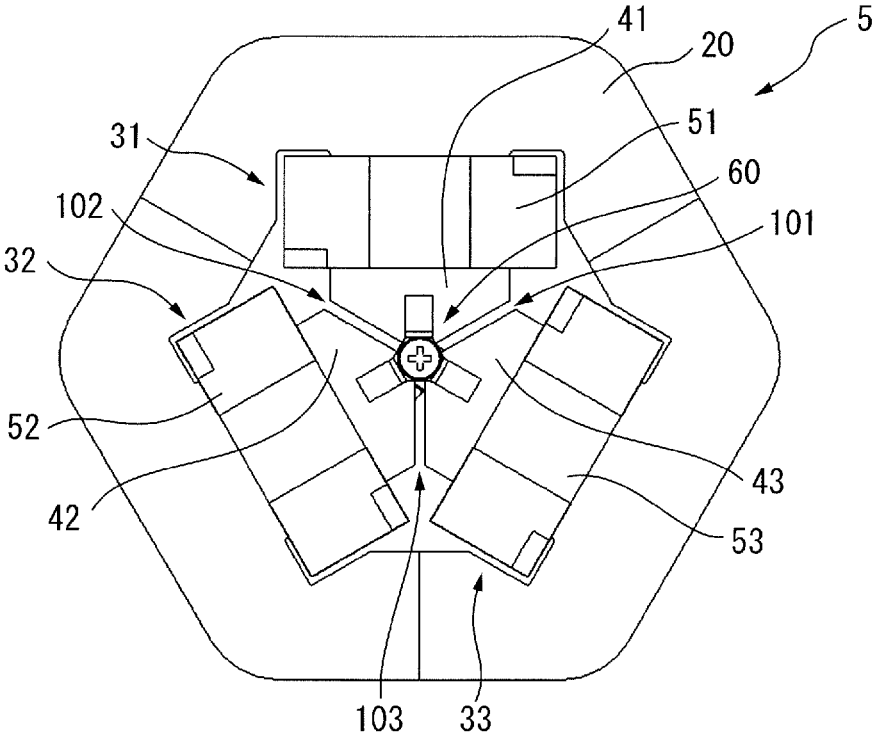
FIG. 1A is a top view of a three-phase reactor based on the present invention.

Embodiments of the present invention will be described below with reference to the accompanying drawings. In the following figures, similar members are designated with the same reference numerals. These figures are properly modified in scale to assist the understanding thereof.

Figure 1B:
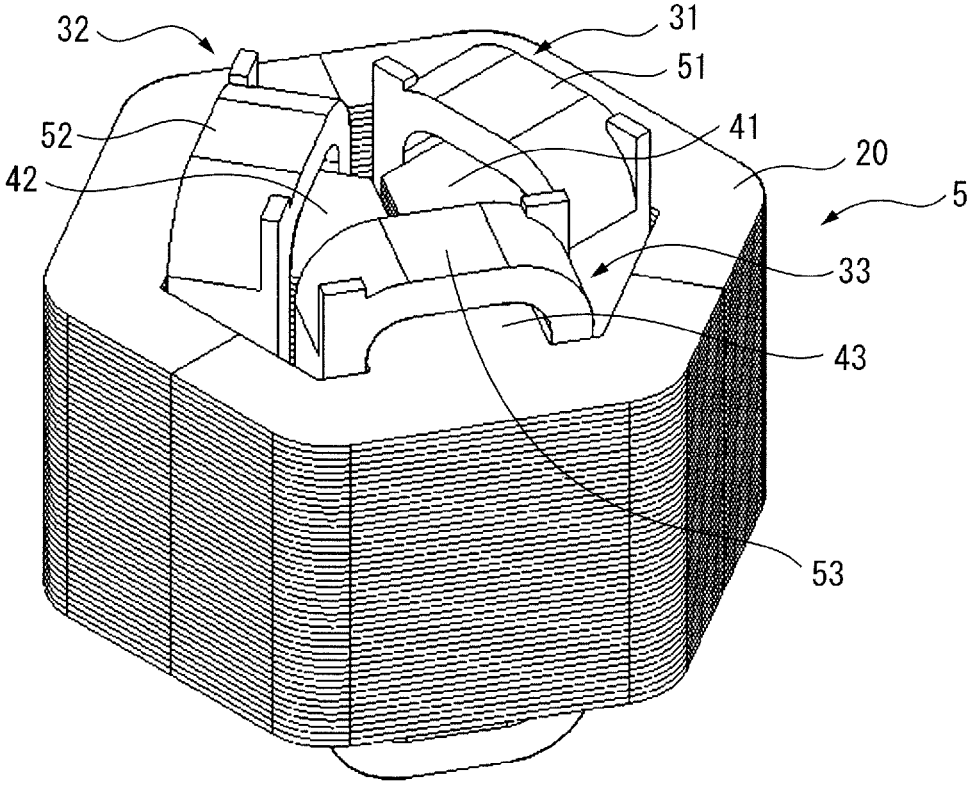
FIG. 1B is a perspective view of the three-phase reactor shown in FIG. 1A.

FIG. 1A is a top view of a three-phase reactor based on the present invention. FIG. 1B is a perspective view of the three-phase reactor shown in FIG. 1A.

As shown in FIG. 1A and FIG. 1B, a three-phase reactor 5 includes an outer peripheral iron core 20, and three iron core coils 31 to 33 which can be magnetically coupled to the outer peripheral iron core 20. In FIG. 1A, the iron core coils 31 to 33 are arranged inside the outer peripheral iron core 20 having a hexagonal shape. Note that the number of iron core coils may be a multiple of 3, which is greater than 3.

As can be seen from the figures, the iron core coils 31 to 33 respectively include iron cores 41 to 43, which radially extend, and the coils 51 to 53 wound around the iron cores. The radially outside ends of the iron cores 41 to 43 are in contact with the outer peripheral iron core 20, or are integral with the outer peripheral iron core 20.

Further, the radially inside ends of the iron cores 41 to 43 are positioned in the vicinity of the center of the outer peripheral iron core 20. In FIG. 1A etc., the radially inside ends of the iron cores 41 to 43 converge on the center of the outer peripheral iron core 20, and the tip angle of each end is approximately 120 degrees. Further, the radially inside ends of the iron cores 41 to 43 are spaced from one another via gaps 101 to 103 which can be magnetically coupled.

In other words, the radially inside end of the iron core 41 is spaced from the radially inside ends of the two iron cores 42 and 43, which are adjacent to the iron core 41, via the gaps 101 and 102. The same is true in the other iron cores 42 and 43. Further, in some embodiments that will be described later, the gaps 101 to 103 are not illustrated.

As seen above, in the present invention, a central iron core positioned at the center of the three-phase reactor 5 is not necessary, and accordingly, the three-phase reactor 5, which has a light weight and a simple structure, can be obtained. Further, the three iron core coils 31 to 33 are surrounded by the outer peripheral iron core 20, and accordingly, magnetic fields, which occur from the coils 51 to 53, do not leak to the outside of the outer peripheral iron core 20. Further, the gap 101 to 103 having a given thickness can be provided at a low cost. This is advantageous in design to reactors having conventional structures.

Further, in the three-phase reactor 5 of the present invention, the difference in the magnetic path length between phases is smaller than that of reactors having conventional structures. Thus, in the present invention, the unbalance of inductance caused by the difference in the magnetic path length can be reduced.

Figure 2:
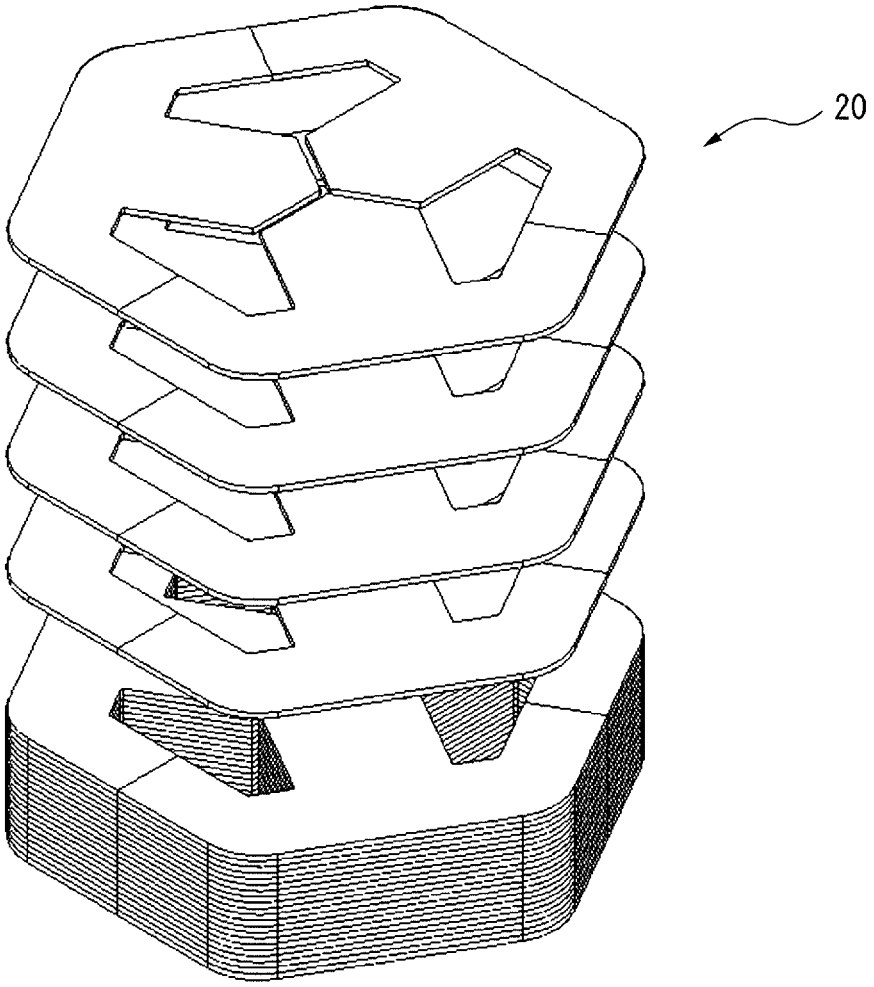
FIG. 2 is an exploded perspective view of an iron core.

FIG. 2 is an exploded perspective view of an iron core. In the example shown in FIG. 2, the outer peripheral iron core 20 is integral with the iron cores 41 to 43. As can be seen from FIG. 2, the outer peripheral iron core 20 and the iron cores 41 to 43 are formed by stacking a plurality of sheet-like magnetic elements, e.g., magnetic steel plates. In this case, the manufacturing cost of the outer peripheral iron core 20 and the iron cores 41 to 43 can be reduced. Note that the outer peripheral iron core 20 and the iron cores 41 to 43 may be separately formed by stacking a plurality of sheet-like magnetic elements, e.g., magnetic steel plates. Note that the iron cores 41 to 43 may each be a core-shaped molded article composed of a magnetic element but not sheet-like magnetic elements.

When such a three-phase reactor 5 is driven, the iron cores 41 to 43 vibrate in, specifically, the vicinity of the gaps 101 to 103. If the iron cores 41 to 43 are formed separately from the outer peripheral iron core 20, such vibrations would be enhanced.

Figure 3:
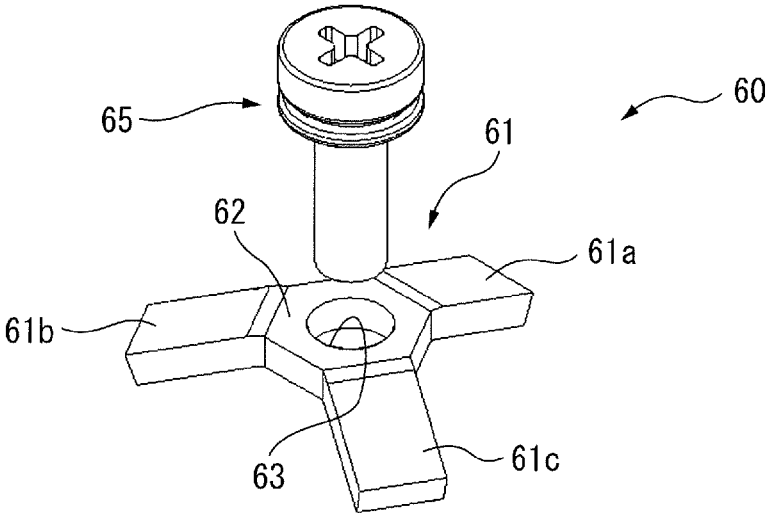
FIG. 3 is a perspective view of a vibration suppressing structure part.

In order to solve these problems, as can be seen from FIG. 1A, a vibration suppressing structure part 60 is disposed at the center of the three-phase reactor 5 of the present invention. FIG. 3 is a perspective view of the vibration suppressing structure part. As shown in FIG. 3, the vibration suppressing structure part 60 includes a vibration reducing part 61 and a fixture 65.

The vibration reducing part 61 has an elastic structure, or is made of an elastic body, e.g., rubber. In other words, the vibration reducing part 61 is preferably made of a non-magnetic body. In this case, the magnetic permeability is small, and accordingly, the magnetic saturation can be reduced.

The vibration reducing part 61 has a center part 62, and a plurality of, e.g., three extensions 61*a* to 61*c*, which radially extend from the center part 62 and which are arranged at equal intervals. The number of the extensions 61*a* to 61*c* is equal to or less than the number of the gaps 101 to 103 of the three-phase reactor 5.

It is preferable that the extensions 61*a* to 61*c* are inclined with respect to a plane including the center part 62. In other words, the extensions 61*a* to 61*c* extend at a predetermined angle with respect to the center part 62. The fixture 65 has a shape suitable for being inserted to an opening 63 of the center part 62. The fixture 65 is, e.g., a screw.

Referring again to FIG. 1A, the vibration suppressing structure part 60 is disposed at the center of the three-phase reactor 5. In other words, the vibration suppressing structure part 60 is disposed at an intersection of the gaps 101 to 103 or the vicinity of the intersection. As can be seen from FIG. 1A, the extensions 61*a* to 61*c* of the vibration reducing part 61 respectively engage with the top surfaces of the iron cores 41 to 43.

The fixture 65 passes through the opening 63 of the center part 62, and then, presses the vibration reducing part 61 against the iron cores 41 to 43. This causes the extensions 61*a* to 61*c* of the vibration reducing part 61 to change in shape, and then, to be positioned in the same plane in which the center part 62 is positioned. Consequently, the fixture 65 secures the vibration reducing part 61 to the iron cores 41 to 43. For this object, a male screw may be used as the fixture 65, and a thread (internal thread) to be screw-engaged with the fixture 65 may be formed at the corresponding position in each of the iron cores 41 to 43. Alternatively, an internal thread may be formed in the fixture 65, and an external thread may be formed at the corresponding position in each of the iron cores 41 to 43. The same is true in embodiments that will be described later.

As seen above, in the present invention, the vibration suppressing structure part 60 fixes the iron cores 41 to 43. Thus, when the three-phase reactor 5 is driven, the vibrations can be reduced, and consequently, noises can be prevented from occurring, and the three-phase reactor can be prevented from deteriorating.

Further, the vibration suppressing structure part 60 is disposed only at an intersection of the gaps 101 to 103 or the vicinity of the intersection. Thus, the size of the three-phase reactor 5 is not increased by the vibration suppressing structure part 60, and the manufacturing cost is not drastically increased.

Further, the vibration reducing part 61 has elasticity, and accordingly, can fix the iron cores 41 to 43 without depending on the thickness of the iron cores 41 to 43. Thus, an attaching operation of the vibration suppressing structure part 60 can be incredibly easily performed.

Figure 4:
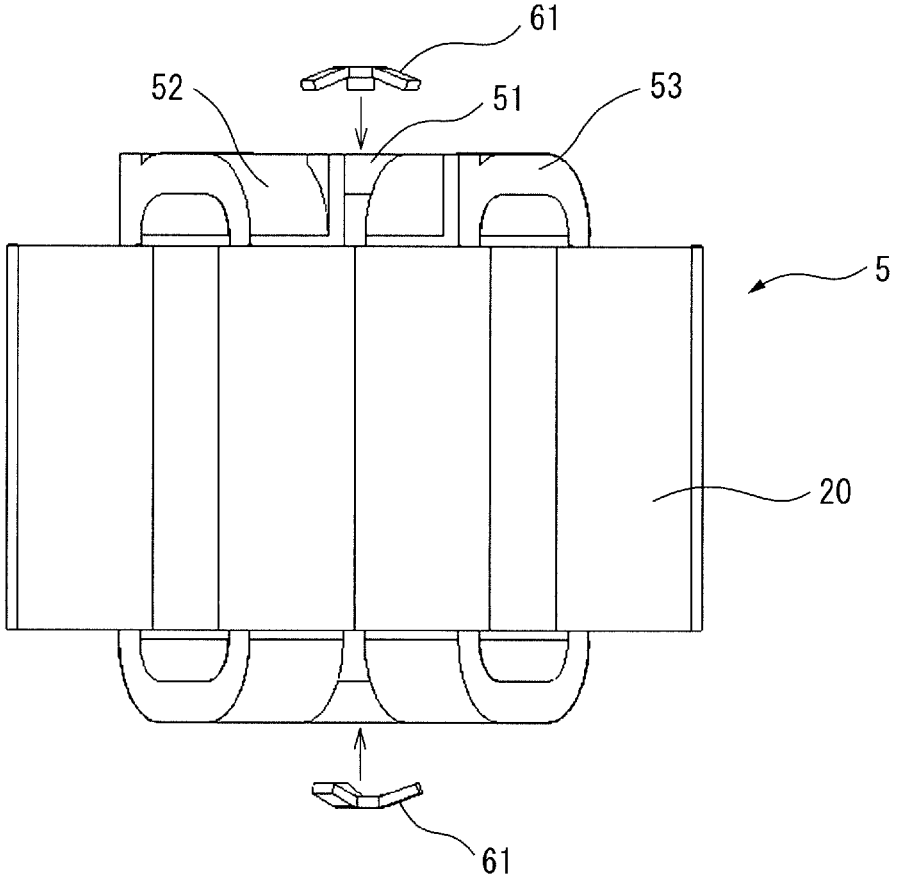
FIG. 4 is a side view of a three-phase reactor based on another embodiment of the present invention.

FIG. 4 is a side view of a three-phase reactor based on another embodiment of the present invention. As shown in FIG. 4, it is preferable that vibration reducing parts 61 are disposed on both end faces of the three-phase reactor 5. Although not illustrated in FIG. 4, the vibration reducing parts 61 are secured by fixtures 65 as described above. In this way, it is preferable that two vibration suppressing structure parts 60 are used for one three-phase reactor 5. Thus, the vibration reducing effect can be enhanced by a relatively simple structure.

Figure 6A:
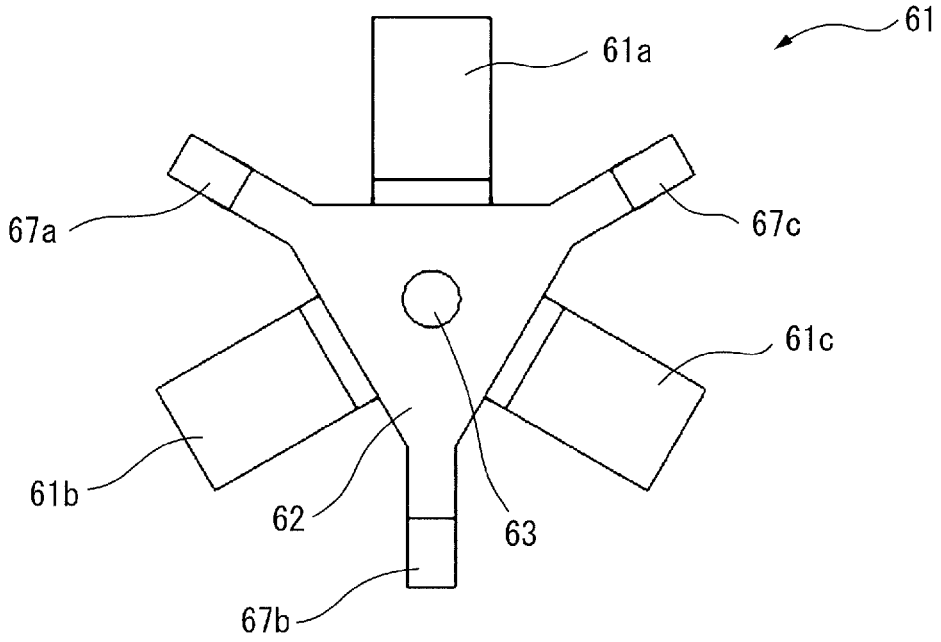
FIG. 6A is a top view of a vibration reducing part in an additional embodiment.
Figure 6B:
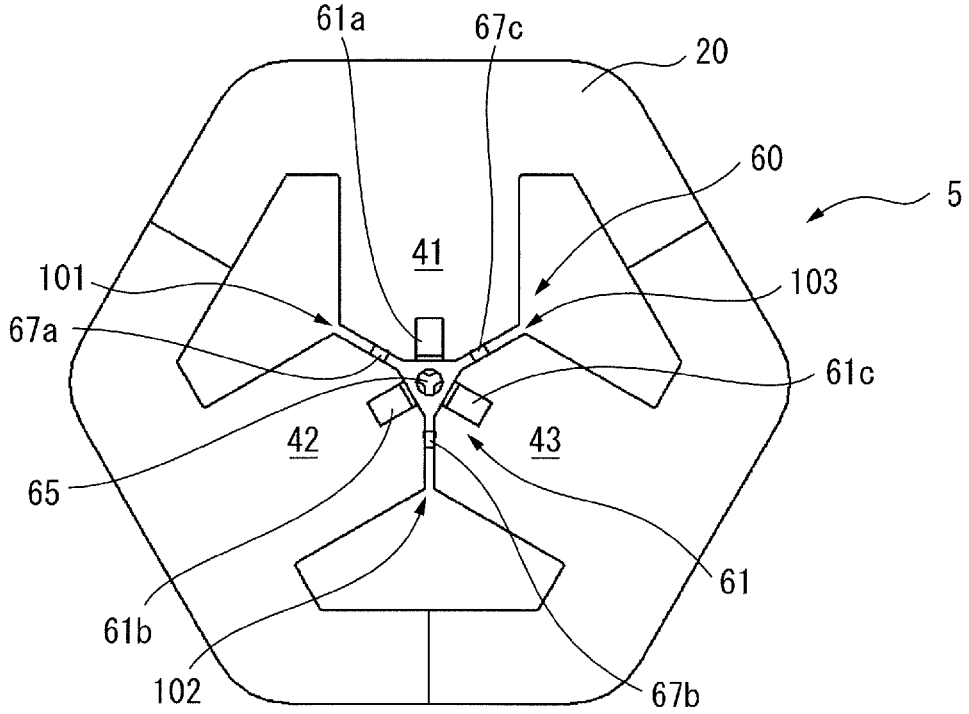
FIG. 6B is a top view of a three-phase reactor to which the vibration reducing part shown in FIG. 6A is attached.
Figure 6C:
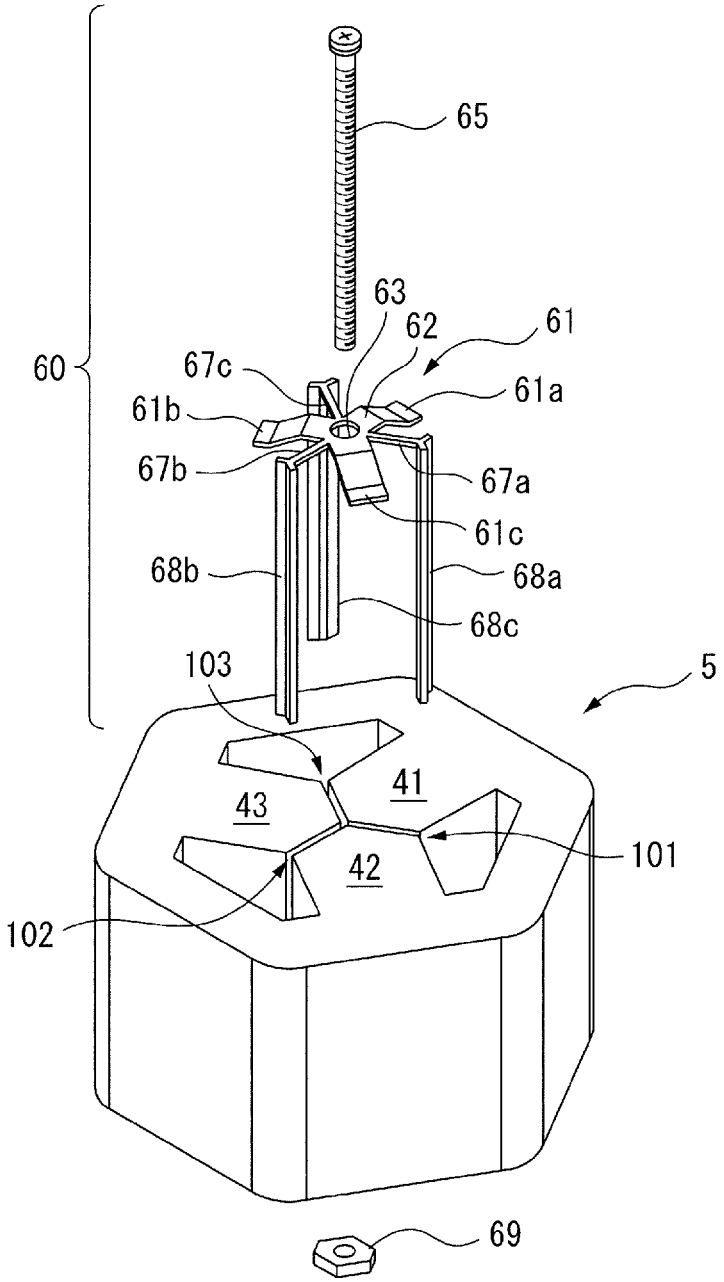
FIG. 6C is an exploded perspective view of another reactor in an additional embodiment.

Note that, even when, unlike the above case, a male screw is not used as the fixture 65, and a thread (internal thread) to be screw-engaged with the fixture 65 is not formed at the corresponding position in each of the iron cores 41 to 43, a vibration reducing part may be fixed by a screw, which is longer than the thickness of the iron cores, and a nut 69 (see FIG. 6C).

Figure 5A:
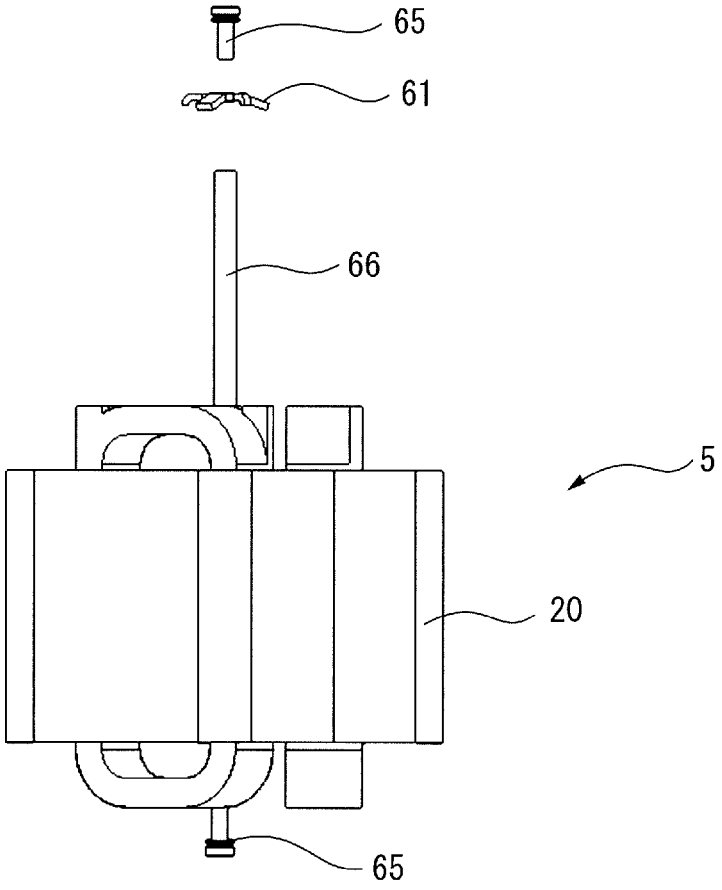
FIG. 5A is a side view of a three-phase reactor based on still another embodiment of the present invention.
Figure 5B:
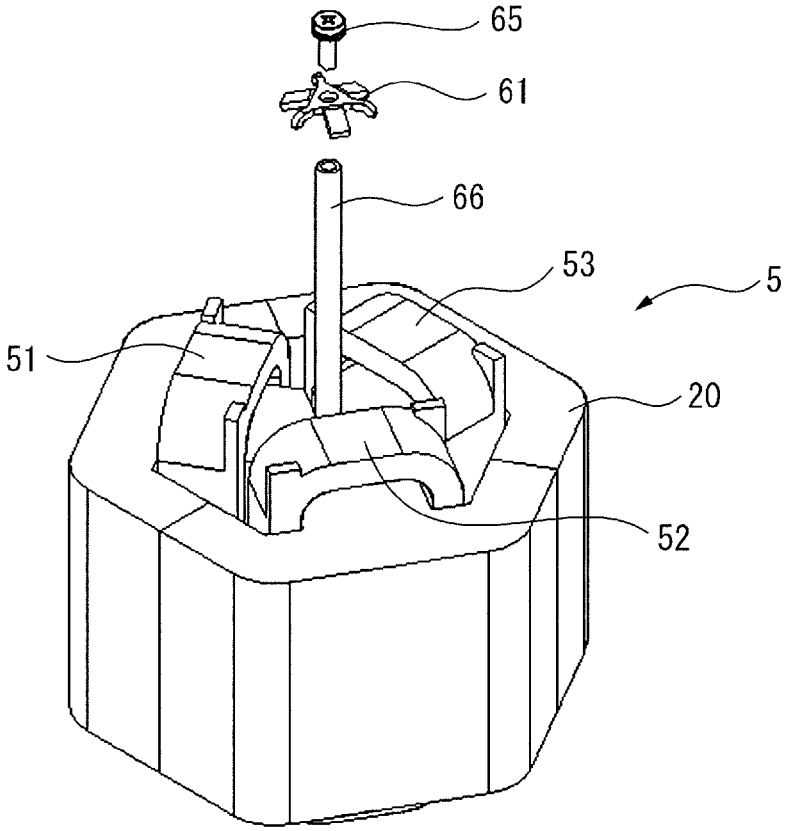
FIG. 5B is a perspective view of the three-phase reactor shown in FIG. 5A.

FIG. 5A is a side view of a three-phase reactor based on still another embodiment of the present invention. FIG. 5B is a perspective view of the three-phase reactor shown in FIG. 5A. In the embodiment shown in FIG. 5A and FIG. 5B, a long rod 66 is inserted in the center of three-phase reactor 5. Strictly speaking, the rod 66 is inserted into the three-phase reactor 5 at a position corresponding to an intersection of the gaps 101 to 103. The length of the rod 66 is substantially equal to or slightly shorter than the axial length of the three-phase reactor 5.

A threaded portion is formed in the inner surface of a recess formed in one of the end faces of the rod 66. The fixture 65 as a screw is screw-engaged with the threaded portion of the rod 66. The vibration reducing part 61 is further firmly fixed by screw-engaging the fixture 65 with the rod 66. Consequently, it will be understood that the vibration reducing effect is further enhanced. Note that the rod 66 may be a female screw, and the fixture 65 may be a male screw, and vice versa.

Note that a recess, in which a similar threaded portion is formed, may be formed in the other end face of the rod 66. In this case, another fixture 65 is screw-engaged with the rod 66 along with another vibration reducing part 61. Thus, the vibration reducing effect can be further enhanced. Further, it will be understood that, even when the rod 66 is simply inserted into the three-phase reactor 5 at a position corresponding to an intersection of the gaps 101 to 103, a substantially similar effect can be obtained. Note that the rod 66 may be a female screw, and the fixture 65 may be a male screw, and vice versa.

FIG. 6A is a top view of a vibration reducing part in an additional embodiment. In the vibration reducing part 61 shown in FIG. 6A, legs 67*a* to 67*c* are each disposed between two adjacent ones of the extensions 61*a* to 61*c*. The legs 67*a* to 67*c* each extend radially outward at the intermediate position between two adjacent ones of the extensions. Note that the legs 67*a* to 67*c* are integral with the vibration reducing part 61.

FIG. 6B is a top view of a three-phase reactor to which the vibration reducing part shown in FIG. 6A is attached. Note that, to facilitate understanding, the coils 51 to 53 are not illustrated in FIG. 6B. As shown in FIG. 6B, when the vibration suppressing structure part 60 is attached, the extensions 61*a* to 61*c* of the vibration reducing part 61 respectively engage with the top surfaces of the iron cores 41 to 43, and the legs 67*a* to 67*c* are respectively inserted to the gaps 101 to 103.

In this case, the legs 67*a* to 67*c* are each disposed between adjacent ones of the iron cores 41 to 43. Thus, it will be understood that, even when the iron cores 41 to 43 are formed separately from the outer peripheral iron core 20, the iron cores 41 to 43 can be prevented from rotating, and the iron cores 41 to 43 can be further firmly secured. Consequently, it will be understood that the vibrations can be further reduced.

FIG. 6C is an exploded perspective view of another reactor in an additional embodiment. Note that, to facilitate understanding, the coils 51 to 53 are not illustrated in FIG. 6C. From the tips of the legs 67*a* to 67*c* of the vibration reducing part 61 shown in FIG. 6C, rod-like additional legs 68*a* to 68*c* perpendicularly extend with respect to the legs 67*a* to 67*c*.

The length of the legs 67*a* to 67*c* is slightly longer than the length (radial distance) of the gaps 101 to 103.

When the vibration reducing part 61 is disposed at one end of the reactor 5, the additional legs 68*a* to 68*c* come into contact with the side faces of the iron cores 41 to 43. For this object, it is preferable that the additional legs 68*a* to 68*c* each have a substantially Y-shaped cross-sectional surface. Subsequently, a screw, i.e., the fixture 65 is inserted into the opening 63, and then, is secured, by a nut 69, at the other end of the reactor 5. In this case, the additional legs 68*a* to 68*c* radially inward hold the iron cores 41 to 43. Further, the fixture 65 and the nut 69 axially hold the iron cores 41 to 43. Thus, it will be understood that, in addition to the aforementioned effect, vibrations, which occur in the vicinity of the gaps 101 to 103, can be further reduced. Note that the use of the nut 69 may be omitted, and even in this case, a substantially similar effect can be obtained. Alternatively, the nut 69 may be a part of the fixture 65.

Figure 7A:
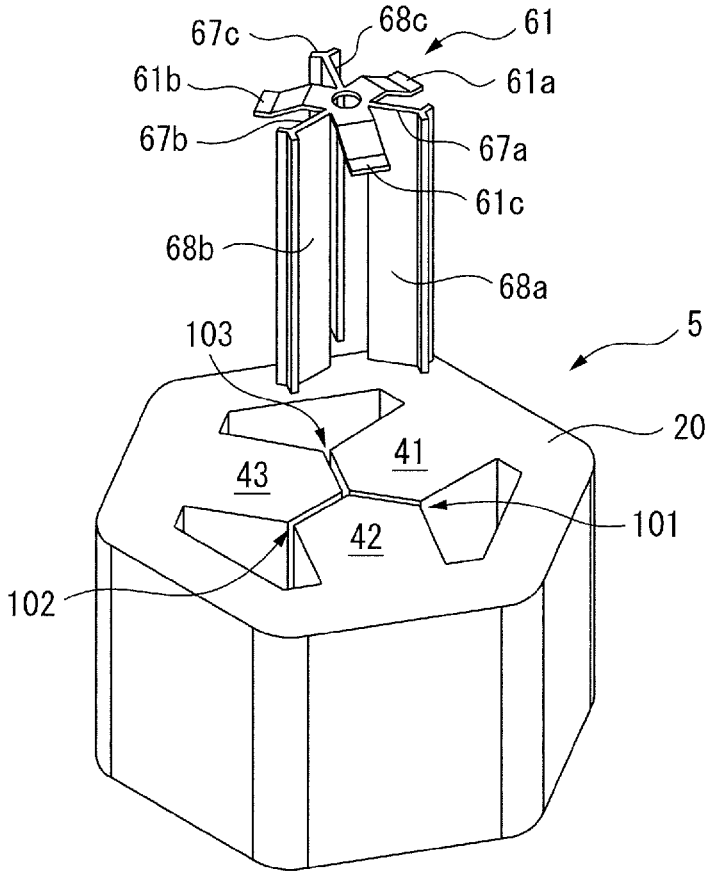
FIG. 7A is an exploded perspective view of a reactor in still another embodiment.
Figure 7B:
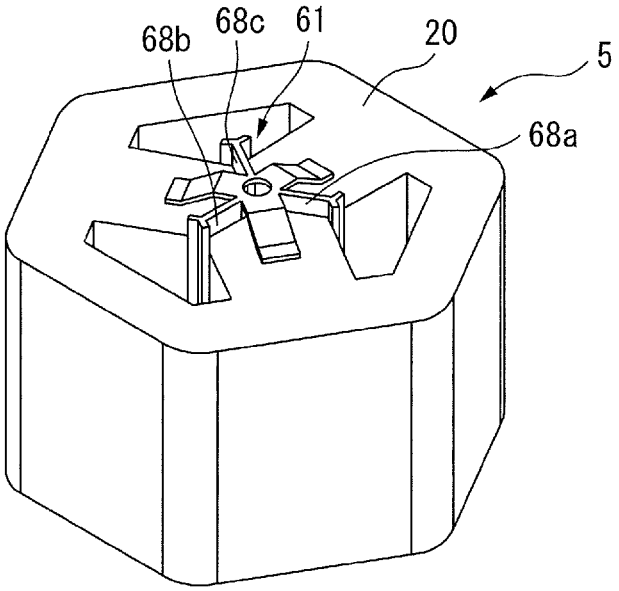
FIG. 7B is a perspective view of the reactor shown in FIG. 7A.

FIG. 7A is an exploded perspective view of a reactor in still another embodiment. FIG. 7B is a perspective view of the reactor shown in FIG. 7A. For the sake of simplicity, in FIG. 7A and FIG. 7B, the additional legs 68*a* to 68*c* of the vibration reducing part 61 shown in FIG. 7A, in which the fixture 65 etc. are not illustrated, have flat longitudinal portions corresponding to the legs 67*a* to 67*c*. Thus, when the vibration reducing part 61 is disposed at one end of the reactor 5, as shown in FIG. 7B, the additional legs 68*a* to 68*c* are respectively inserted into the gaps 101 to 103. Thus, it will be understood that vibrations, which occur in the vicinity of the gaps 101 to 103, can be further reduced than the embodiment in FIG. 6C.

Figure 7C:
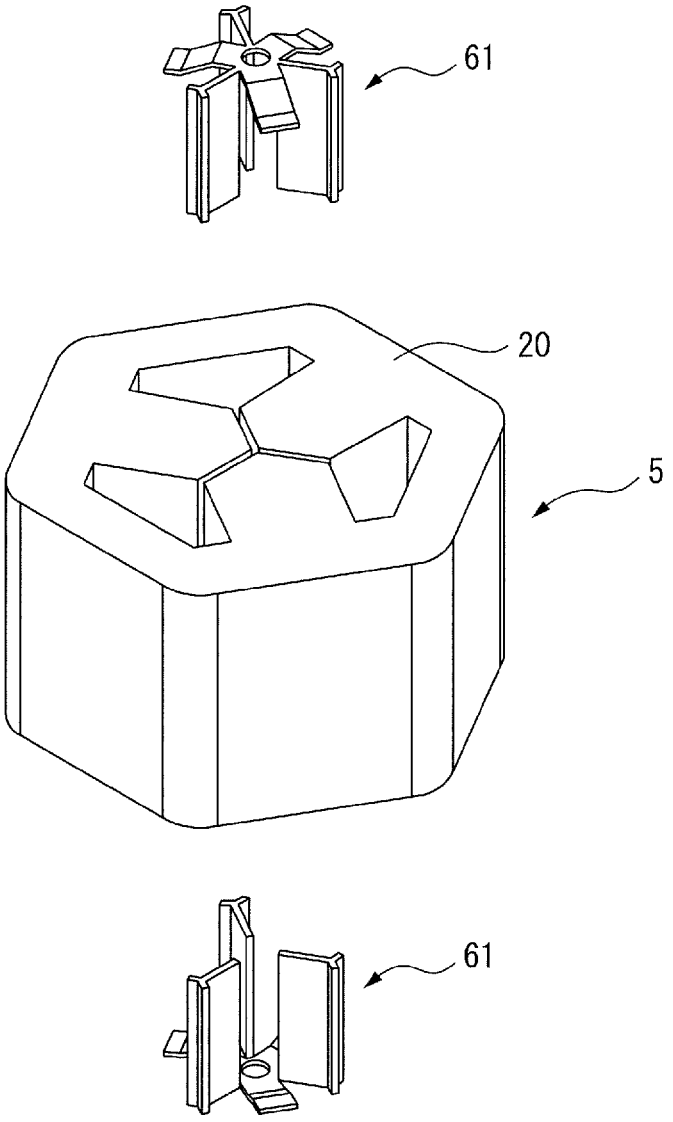
FIG. 7C shows a modification of the embodiment shown in FIG. 4.

FIG. 7C is a modification of the embodiment shown in FIG. 4. FIG. 7C shows a vibration reducing part 61 similar to that in FIG. 7A. It is preferable that the axial length of the additional legs 68*a* to 68*c* is not greater than the half of the axial length of the reactor 5. It will be understood that, even in this case, an effect substantially similar to that in the embodiment shown in FIG. 4 can be obtained.

Figure 8:
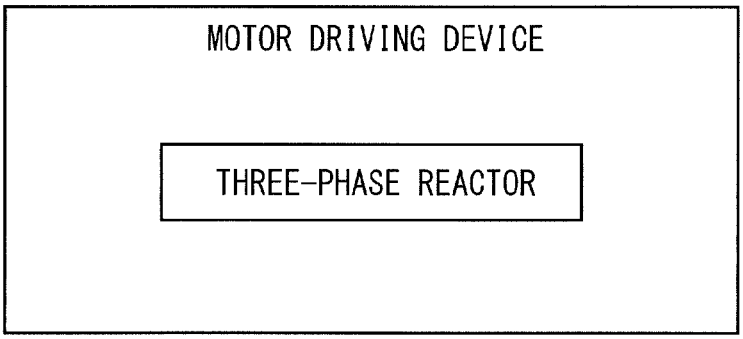
FIG. 8 is a view of a motor driving device including a three-phase reactor of the present invention.

FIG. 8 is a view of a motor driving device including a three-phase reactor of the present invention. In FIG. 8, the three-phase reactor 5 is provided in the motor driving device.

In such a case, it will be understood that the motor driving device including the three-phase reactor 5 can be easily provided. Any appropriate combination of these embodiments is included in the scope of the present invention.

Disclosed Aspects

According to a first aspect, there is provided a three-phase reactor including an outer peripheral iron core for surrounding the outer periphery of the three-phase reactor, and at least three iron core coils, which are in contact with or coupled to the inner surface of the outer peripheral iron core. The at least three iron core coils include iron cores and coils wound around the iron cores. Gaps, which can be magnetically coupled, are each formed between two adjacent ones of the iron cores. The three-phase reactor further includes a vibration suppressing structure part disposed in the vicinity of the gaps so as to reduce vibrations occurring at the gaps.

According to a second aspect, in the reactor according to the first aspect, the vibration suppressing structure part includes a vibration reducing part having an elastic configuration, and a fixture for securing the vibration reducing part to the iron cores.

According to a third aspect, in the reactor according to the first or second aspect, the vibration suppressing structure part is disposed at least one end of the three-phase reactor in the stacking direction of the iron cores.

According to a fourth aspect, in the reactor according to any of the first to third aspects, the fixture is a screw or a combination of a screw and a nut.

According to a fifth aspect, in the reactor according to the second aspect, the vibration reducing part includes at least one leg to be inserted between two adjacent ones of the iron cores.

According to a sixth aspect, in the reactor according to the second aspect, the vibration reducing part is formed from a non-magnetic body.

According to a seventh aspect, there is provided a motor driving device including the reactor according to any of the first to sixth aspects.

Effects of Aspects

In the first and second aspects, the vibration suppressing structure part, which includes a vibration reducing part and a fixture, is disposed only in the vicinity of the gaps. Thus, the size of the three-phase reactor is not increased by the vibration suppressing structure part, and the manufacturing cost is not drastically increased. Further, the iron cores can be secured without depending on the thickness of the iron cores in the respective phases.

In the third aspect, the vibration reducing effect can be enhanced by a relatively simple structure.

In the fourth aspect, the vibration reducing effect can be enhanced by a relatively simple structure.

In the fifth aspect, the leg is disposed between the iron cores. This prevents the iron cores from rotating, and enables the iron cores to be firmly secured.

In the sixth aspect, the magnetic permeability is small, and accordingly, the magnetic saturation can be reduced.

In the seventh aspect, the manufacturing cost and the dimensions of the motor driving device can be prevented from drastically increasing.

The present invention has been described above using exemplary embodiments. However, a person skilled in the art would understand that the aforementioned modifications and various other modifications, omissions, and additions can be made without departing from the scope of the present invention.

What is claimed is:

1. A three-phase reactor comprising:

an outer peripheral iron core for surrounding the outer periphery of the three-phase reactor;

at least three iron core coils, which are in contact with or coupled to the inner surface of the outer peripheral iron core, wherein the at least three iron core coils include iron cores and coils wound around the iron cores, and gaps, which can be magnetically coupled, are each formed between two adjacent ones of the iron cores; and a vibration suppressing structure part disposed at an intersection of the gaps or the vicinity of the intersection so as to reduce vibrations occurring at the gaps, the vibration suppressing structure part includes:

a vibration reducing part having a plurality of elastic extensions spaced apart from each other, each of the plurality of elastic extensions radially extending from the intersection of the gaps to a respective one of the iron cores, and a fixture for pressing each of the plurality of elastic extensions against the respective one of the iron cores.

* * * * *